US007543354B2

(12) United States Patent
Lee et al.

(10) Patent No.: US 7,543,354 B2
(45) Date of Patent: Jun. 9, 2009

(54) BRUSH HEAD FOR AUTOMATIC DISSOLUTION VESSEL CLEANER

(75) Inventors: Luke Lee, Belle Mead, NJ (US); Yu Sheng Zhang, Stewartsville, NJ (US)

(73) Assignee: Logan Instruments Corporation, Somerset, NJ (US)

( * ) Notice: Subject to any disclaimer, the term of this patent is extended or adjusted under 35 U.S.C. 154(b) by 641 days.

(21) Appl. No.: 11/267,687

(22) Filed: Nov. 4, 2005

(65) Prior Publication Data

US 2007/0101533 A1 May 10, 2007

(51) Int. Cl.
*A46B 13/04* (2006.01)
*B08B 9/087* (2006.01)

(52) U.S. Cl. ..... 15/302; 15/304; 15/56

(58) Field of Classification Search ..... 15/56–59, 15/65, 69–71, 104.9, 164, 246.5, 302, 304, 15/320, 322, 385
See application file for complete search history.

(56) References Cited

U.S. PATENT DOCUMENTS 2,726,415 A * 12/1955 Volckening ..... 15/104.9
5,109,562 A * 5/1992 Albrecht ..... 15/56

* cited by examiner

*Primary Examiner*—Mark Spisich
(74) *Attorney, Agent, or Firm*—Brian Roffe

(57) ABSTRACT

Brush head for cleaning a vessel and use in an automatic dissolution vessel cleaning apparatus which includes a rotatable shaft defining a through passage, an upper end of which is operatively connected to a vacuum source, an inflow housing having at least one channel through which cleaning fluid is pumped and to which the shaft is rotatably mounted, and a brush assembly mounted on the shaft below the housing such that a lower end of the passage is situated below the brush assembly. In use, when the brush head is inserted into the vessel, cleaning fluid is directed through the channel(s) into the vessel while the shaft rotates causing the brush assembly to rotate and clean an inner wall of the vessel with fluid in the vessel being drawn into the passage via its lower end upon coupling of its upper end to the vacuum source.

20 Claims, 7 Drawing Sheets

BRUSH HEAD FOR AUTOMATIC DISSOLUTION VESSEL CLEANER

FIELD OF THE INVENTION

The present invention relates generally to a brush head for use in cleaning a dissolution vessel and more specifically to a brush head for use in cleaning a dissolution vessel while situated in a dissolution tester and to an apparatus for cleaning dissolution vessels while situated in a dissolution tester including the same. The brush head is in particular designed for attachment to an actuator of an automatic dissolution vessel cleaner.

BACKGROUND OF THE INVENTION

Tablet dissolution testing is a very tedious job, and one of the more tedious aspects is the thorough washing of the dissolution vessels required after each test. To wash the dissolution vessels after each test, a user often must remove the dissolution vessels from the dissolution tester one by one, walk to a sink or other washing area to manually wash it and then walk back to the dissolution tester in order to put the cleaned dissolution vessel back into the dissolution tester in preparation for the next test.

One potentially dangerous situation which arises when washing the dissolution vessels is that upon removal from the dissolution tester, each dissolution vessel is usually full of dissolution media, and may contain acid or perhaps dangerous active ingredients from the tested tablet or other drug form. As such, it is very dangerous for the user to hold the dissolution vessel and walk around the testing facility, e.g., to the sink to manually wash it.

Another concern which arises during washing of dissolution vessels relates to the sufficiency of the washing process since there is no widely accepted way to validate a manually washed dissolution vessel, i.e., to ensure that it is significantly clean for use in the next test. The presence of any residue from a preceding test will adversely affect the results of the subsequent test. Some users wash the dissolution vessels by means of a basic rinse with clean water while others use a brush to clean the dissolution vessels. Testing facility personnel were manually cleaning dissolution vessels for many years while seeking a validated dissolution vessel cleaning method.

Beginning in about 1990, Logan Instruments Corporation of Somerset, N.J., has been producing an Automated Vessel Cleaner Model AVC-100, which is a mobile apparatus for washing dissolution vessels after use while the dissolution vessels are situated in the dissolution tester. With this apparatus, the user is able to wheel the apparatus to the dissolution tester, grasp an actuator having a washing head attached thereto and insert the washing head into the dissolution vessels one at a time. The washing head includes a vacuum tube coupled to a vacuum source, via the actuator, which is effective to remove the fluid in the dissolution vessel while water is pumped through nozzles to spray around the sides of the dissolution vessel to clean it. Water, or another cleaning fluid, is provided to the nozzles through tubes leading from a water source via the actuator. A later modification of this apparatus includes an optional heater to heat the water being sprayed around the sides of the dissolution vessel, as well as a timer to time the washing of each dissolution vessel to enable the establishment of validation protocols. The apparatus also includes a waste tank in which water removed from the dissolution vessels is stored.

One minor drawback of this apparatus is that it was found that the force of the water spray was not strong enough to ensure the dissolution vessels are thoroughly cleaned after all drug tests. Rather, in certain instances, some drug residue was found to adhere to walls of dissolution vessels such that even when using the AVC-100 apparatus, it was still necessary to apply a brush to remove residue remaining on the vessel walls after the washing head was removed from the dissolution vessel.

It would therefore be desirable to provide a head for the apparatus which almost certainly ensures that there is no drug residue remaining on the vessel walls after the washing cycle.

OBJECTS AND SUMMARY OF THE INVENTION

It is an object of the present invention to provide a new and improved brush head for cleaning a vessel, in particular a dissolution vessel after use in a dissolution test.

It is yet another object of the present invention to provide a new and improved brush head for a vessel cleaning apparatus used, for example, to clean dissolution vessels when retained in a dissolution tester.

It is still another object of the present invention to provide a new and improved brush head for a vessel cleaning apparatus which provides a sufficiently strong washing and brushing force to ensure that vessels cleaned using the brush head are thoroughly cleaned and do not require any subsequent cleaning.

It is another object of the present invention to provide a new and improved apparatus for cleaning dissolution vessels used, for example, during tablet dissolution testing, and/or while the dissolution vessels are retained in a dissolution tester.

In order to achieve these objects and others, a brush head for cleaning a vessel in accordance with the invention includes a rotatable shaft defining a through passage, an upper end of which is operatively connected to a vacuum source, an inflow housing having at least one channel through which cleaning fluid is pumped and to which the shaft is rotatably mounted, and a brush assembly mounted on the shaft below the housing such that a lower end of the passage is situated below the brush assembly. In use, when the brush head is inserted into the vessel, cleaning fluid is directed through the channel(s) into the vessel while the shaft rotates causing the brush assembly mounted thereon to rotate and clean an inner wall of the vessel with the fluid in the vessel being drawn into the passage via its lower end upon coupling of its upper end to the vacuum source. The combined effect of the cleaning fluid being pumped into the dissolution vessel around its inner wall and the brush assembly brushing against the inner wall provides a very thorough cleaning of the dissolution vessel, with the likelihood of any residue remaining from the prior use of the vessel being minimal if not non-existent.

The brush assembly optimally includes a spiral brush attached to an outer surface of the shaft and which comprises a series of discrete groups of bristles positioned to provide a downward spiral in a clockwise direction. The groups of bristles are therefore arranged such that the distance between each group of bristles and the inflow housing increases in a direction toward a bottom of the shaft and each group of bristles being positioned behind the group of bristles immediately above in the clockwise direction.

The spiral brush defines a cylindrical brushing envelope and therefore for typical dissolution vessels, additional brushes are needed to clean the hemi-spherical bottom region of the vessel. To this end, the brush assembly further includes a pair of semi-cylindrical brush members arranged at a bottom of the shaft on opposite sides thereof. Each brush member includes a semi-cylindrical plate attached to the shaft and bristles projecting outward from an outer circumferential, semi-cylindrical surface of the plate along the entire surface.

The brush head also includes an annular sealing cover arranged around the shaft and below the inflow housing for engaging the vessel to prevent leakage of fluid from the vessel. An annular guide disc is arranged around the shaft in at least partial alignment with the channel(s) such that cleaning fluid passing through the channel(s) impacts the guide disc and is re-directed outward around the entire circumference of the brush head by the guide disc. The guide disc includes a truncated conical portion which changes the direction of flow of the cleaning fluid after passing through the channel(s) to radially outward directions.

Alternative brush assemblies are also envisioned, but each preferably includes a plurality of bristles arranged to ensure that substantially the entire inner surface of a wall of the vessel is contacted by at least one bristle during rotation of the brush assembly when the brush head is present in the vessel. One such alternative brush assembly includes a pair of brush members each including a J-shaped frame and bristles arranged along substantially the entire outer circumferential surface of the frame.

A brush head in accordance with the invention is preferably used in an automatic dissolution vessel cleaning apparatus including a hand-held actuator, means for pumping cleaning fluid to the actuator, means for drawing fluid from the actuator, and means for providing rotation to an element of the actuator. One such apparatus is the current assignee's AVC-100 apparatus.

Other and further objects, advantages and features of the present invention will be understood by reference to the following specification in conjunction with the annexed drawings.

BRIEF DESCRIPTION OF THE DRAWINGS

The invention, together with further objects and advantages thereof, may best be understood by reference to the following description taken in conjunction with the accompanying drawings wherein like reference numerals identify like elements.

DETAILED DESCRIPTION OF THE INVENTION

Figure 1:
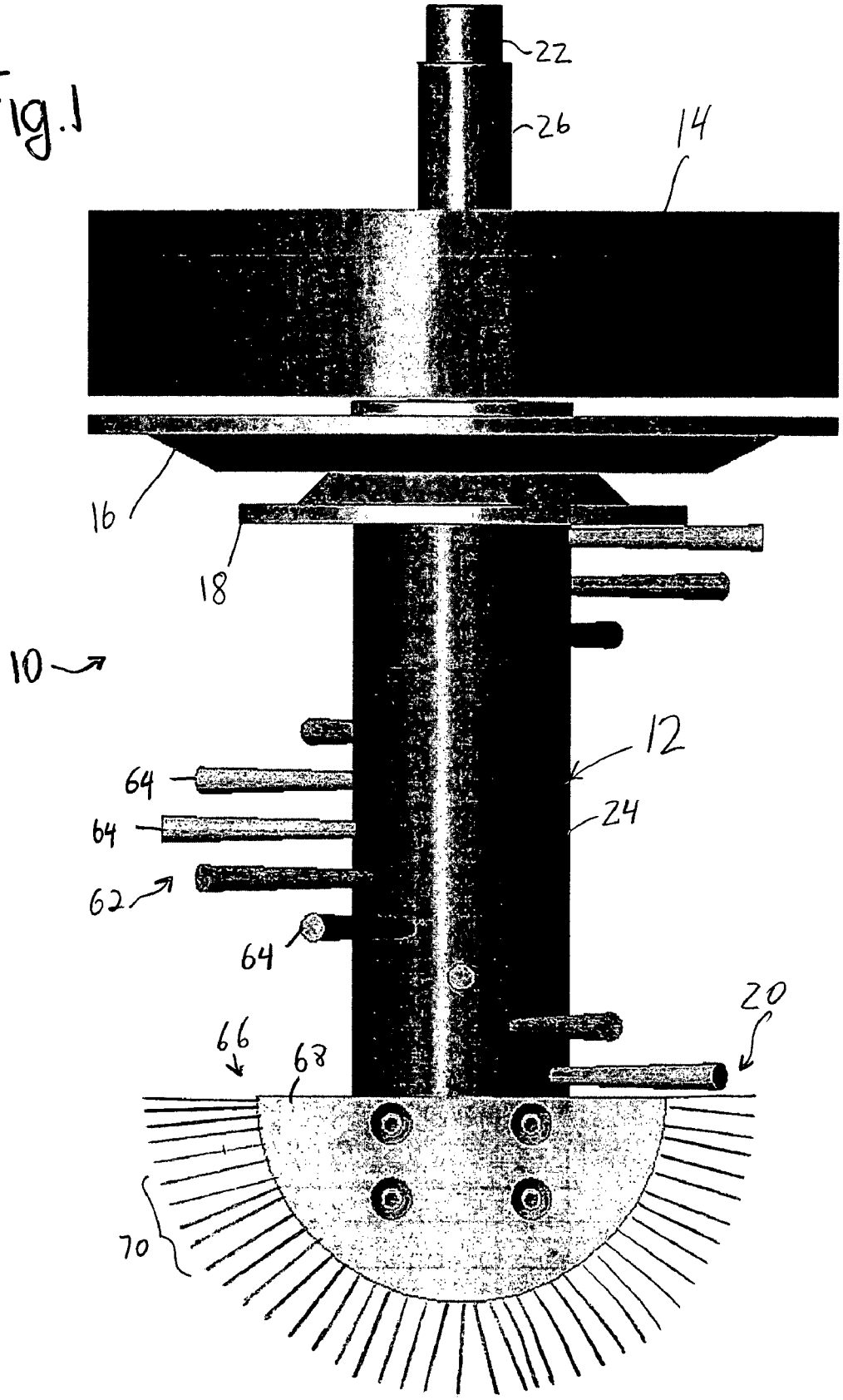
FIG. 1 is a front view of a brush head in accordance with the invention.

Referring to the accompanying drawings wherein like reference numerals refer to the same or similar elements, a brush head in accordance with the invention is designated generally as 10 and comprises a central, rotatable shaft 12, an inflow housing 14 arranged around an upper part of the shaft 12, an annular sealing cover 16 arranged around the shaft 12 and below the inflow housing 14, an annular guide disc 18 arranged around the shaft 12 and below the sealing cover 16, and a brush assembly 20 arranged on the shaft 12. Guide disc 18 and brush assembly 20 are attached to the shaft 12 and thus rotate upon rotation of the shaft 12.

Figure 2:
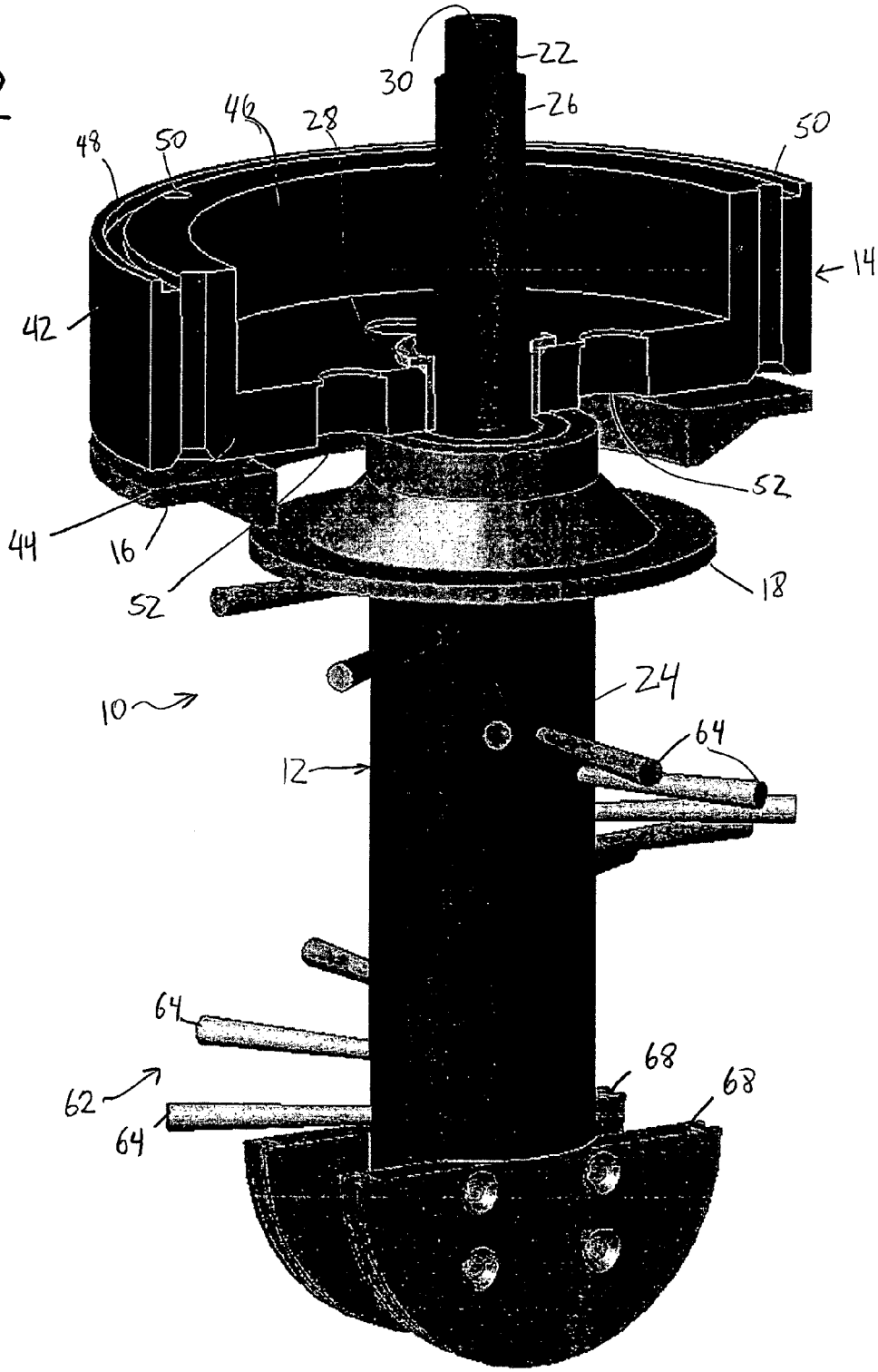
FIG. 2 is a perspective view of the brush head shown in FIG. 1 with its upper part shown in cross-section.
Figure 3:
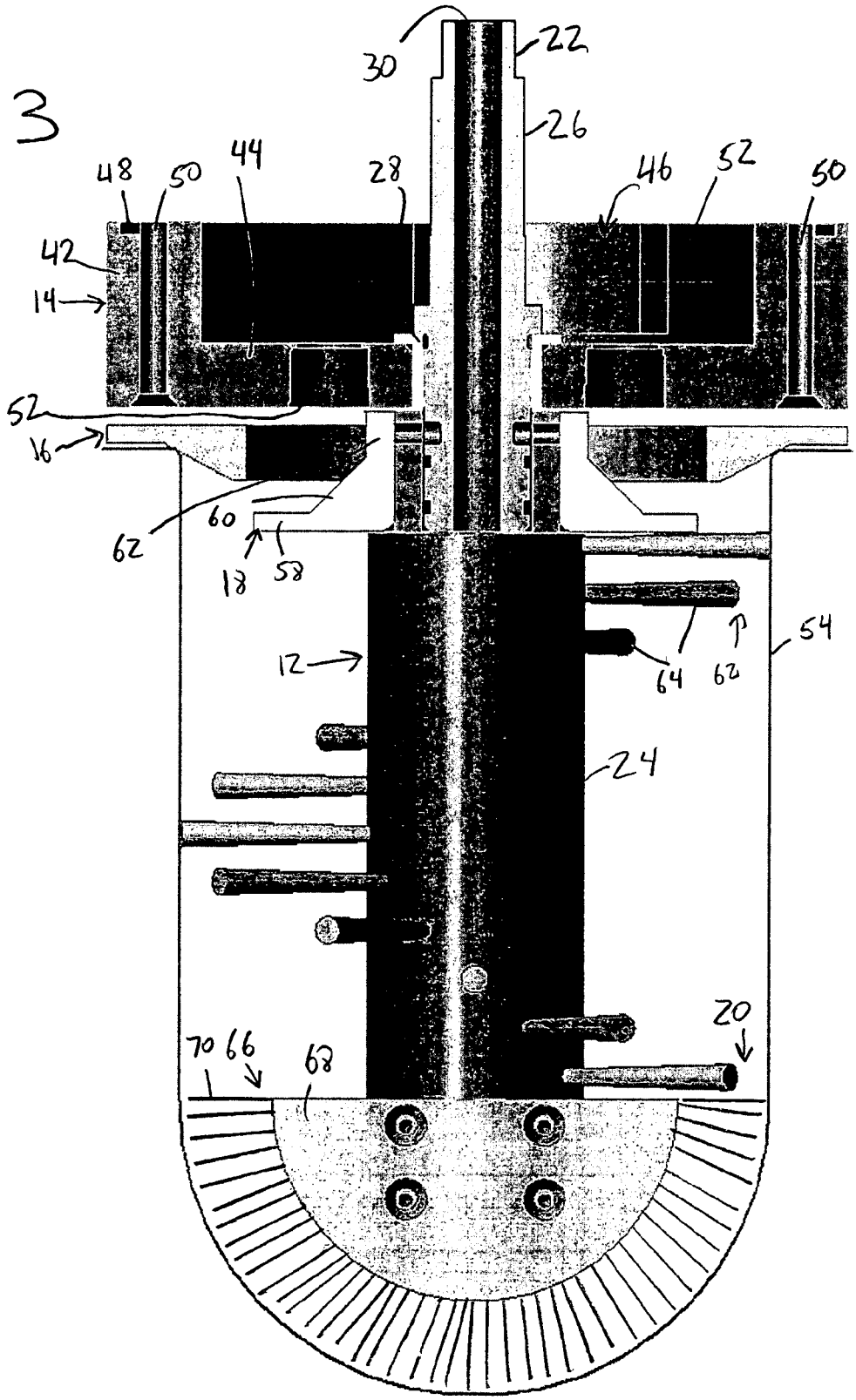
FIG. 3 is a front view of the brush head shown in a dissolution vessel with its upper part shown in cross-section.

Shaft 12 has a coupling portion 22 at its top, a substantially cylindrical, large diameter portion 24 at a lower region and an intermediate portion 26 between the coupling portion 22 and the large diameter portion 24. A bearing 28 is arranged around part of the intermediate portion 26 to rotatably support the shaft 12 on the inflow housing 14 and thereby enable the shaft 12 to rotate relative to the inflow housing 14 (see FIGS. 2-4). Guide disc 18 is arranged at the top of the large diameter portion 24 and brush assembly 20 is arranged on the large diameter portion 24 below the guide disc 18.

Shaft 12 defines an axial passage 30 therein opening at the upper and lower ends of the shaft 12. The lower end of the axial passage 30 is situated below the brush assembly 20 while the upper end of the axial passage 30 is designed to be operatively coupled to a suction source. When the upper end is coupled to the suction source, a suction force is applied through the axial passage 30 and, during use of the brush head 10 when the brush head 10 is placed in a dissolution vessel, draws fluid out of the dissolution vessel to a waste container (not shown). Shaft 12 also includes an axial cavity 32 at its bottom in communication with the axial passage 30 (see FIG. 4).

A vacuum tip 34 is attached to the shaft 12 and defines a passage 36 communicating with the axial passage 30. Vacuum tip 34 is designed to move with the liquid level in the dissolution vessel to ensure a clean vacuum, i.e., to ensure that substantially only fluid is drawn into the axial passage and not air. The vacuum tip 34 includes a tubular member 38 attached to an inside of the axial passage 30 in the shaft 12 and a telescoping shut valve 40 which moves along an outer surface of the tubular member 38 to prevent fluid in the axial passage 30 from flowing back into the vessel. More specifically, in the absence of a suction force being applied to the axial passage 30, the shut valve 40 descends until it contacts a central region of the bottom of the dissolution vessel. When a suction force is applied, the shut valve 40 is raised up on the tubular member 38 to allow fluid to flow into the axial passage 30, the level to which the bottom of the shut valve 40 is raised being dependent on, for example, the level of fluid in the dissolution vessel (see FIG. 4). Using the vacuum tip 34, only a limited amount of fluid is left accumulated on the bottom of the dissolution vessel.

Inflow housing 14 includes a tubular outer wall 42 and circular bottom wall 44 and defines a cavity 46 through which cleaning fluid flows during use of the brush head 10. Outer wall 42 includes an annular groove 48 along its upper surface which mates with the actuator (not shown). The actuator used in combination with the brush head 10 may be the same actuator as in the AVC-100 apparatus described above. It provides a cover which has a circular projection designed to mate with the annular groove 48 and thereby close the cavity 46. It also includes conduits for passing a flow of cleaning fluid from a high-power pump on the main housing of the apparatus to the cavity 46, and conduits through which a suction force generated by a vacuum system on the main housing is transferred to the axial passage 30 and through which the waste fluid from the dissolution vessel is drawn for storage in a waste container in the main housing of the apparatus.

Outer wall 42 also includes through channels 50, the lower ends of which face the guide disc 18. Channels 50 are used to maintain the inflow housing 14 in contact with the guide disc 18 to prevent leakage of cleaning fluid from the cavity 46.

Bottom wall 44 includes channels 52 communicating with the cavity 46 and which align with the guide disc 18. In the illustrated embodiment, there are four channels 52 in the bottom wall 44 of the inflow housing 14; however, any number of channels can be provided.

Figure 4:
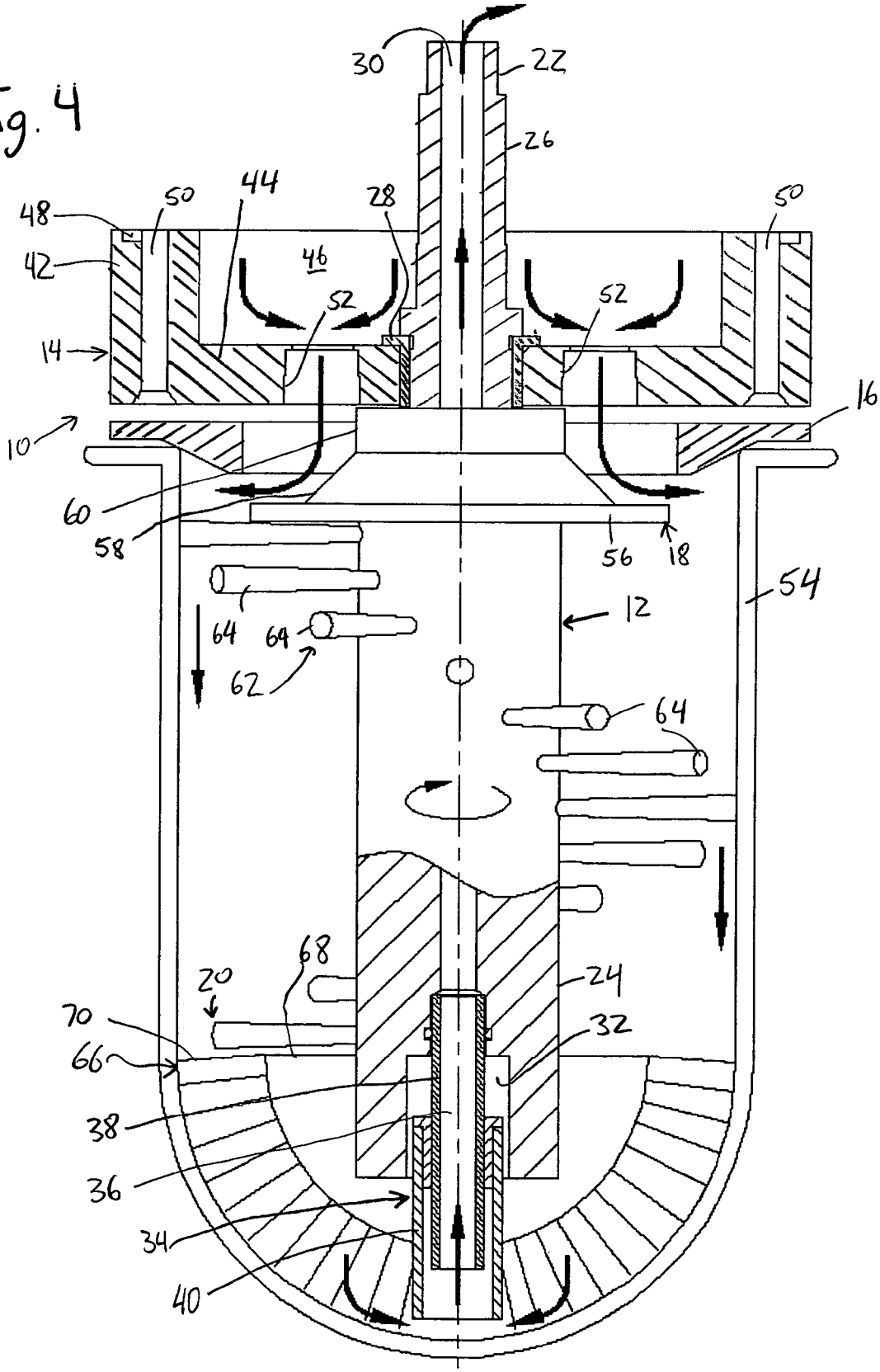
FIG. 4 is a front view similar to FIG. 3 with both lower and upper parts shown in cross-section.

Sealing cover 16 is arranged to contact the upper edge of a dissolution vessel 54 during use of the brush head 10 to prevent fluid from leaking out of the dissolution vessel 54 (see FIG. 4). To this end, the lower surface of the sealing cover 16 may be contoured to fit securely against the upper edge of the dissolution vessel 54 and the size of the sealing cover 16 is determined based on the size of the dissolution vessels to be cleaned using brush head 10.

Guide disc 18 includes an annular flange 56, a truncated conical portion 58 situated above the annular flange 56 and a tubular portion 60 above the conical portion 58 which spaces the conical portion 58 from the bottom wall 44 of the inflow housing 14. Conical portion 58 aligns with at least a part of the channels 52. By virtue of its annular form, guide disc 18 provides a complete 360° spray around the shaft 12 when cleaning fluid flows through the channels 52 into contact with the guide disc 18, and thus provides a spray around the entire inner wall of a dissolution vessel 54 when the brush head 10 is positioned in the vessel 54. Such a 360° is ensured by appropriate selection of the number of the channels 52 and their placement in the bottom wall 44 of the inflow housing 14.

Brush assembly 20 can take various forms. As illustrated, brush assembly 20 has two parts, one of which is in the form of a spiral brush 62 formed from a series of discrete groups of bristles 64 projecting from an outer surface of the large diameter portion 24 of the shaft 12. The groups of bristles 64 are arranged in a specific manner to create a downward flow of fluid during use. Specifically, the distance between each bristle 64 and the guide disc 18 (or sealing cover 16 or inflow housing 14) gradually or incrementally increases in a direction toward the bottom of the shaft 12. Each group of bristles 64 is also positioned behind the group of bristles 64 immediately above in the clockwise direction so that upon clockwise rotation of the shaft 12, the effect of the spiral brush 62 is to urge material they come into contact with downward.

Bristles in each group 64 preferably each have a length which is determined relative to the dissolution vessels for which the brush head 10 is to be used. That is, when the brush head 10 is inserted into a dissolution vessel, the bristles 64 will ideally reach close to or even in contact with the inner wall of the dissolution vessel 54 (see FIG. 4).

The second part of brush assembly 20 is a pair of semi-cylindrical brush members 66 arranged at the bottom of the shaft 12 on opposite sides thereof (the vacuum tip 34 being arranged between the brush members 66). Each brush member 66 includes a semi-cylindrical plate 68 attached to the shaft 12 and bristles 70 projecting outward from an outer circumferential surface of the plate 68 along substantially the entire surface. Brush members 66 are designed to clean the bottom of a dissolution vessel when the brush head 10 is placed into such a dissolution vessel. As such, the bristles 70 preferably each have a length which is determined relative to the dissolution vessels for which the brush head 10 is to be used so that when the brush head 10 is inserted into a dissolution vessel, the bristles 70 will ideally reach close to or even in contact with the inner wall of the dissolution vessel 54 (see FIG. 4).

In view of the placement of bristles 64, 70 forming a brush assembly 20 on the shaft 12, the majority of the cleaning of the dissolution vessel into which the brush head 10 is inserted is done by the rotation of the brush assembly 20 which is effective to dislodge particles from the inner wall of the dissolution vessel. Water being sprayed into the vessel through the channels 52 carries the dislodged particles from the vessel wall to the bottom of the vessel, in combination with the downward force imparted to the water flow by the spiral brush 62.

The use of the brush head 10 will now be described. As mentioned above, the brush head 10 can be used in connection with the AVC-100 cleaning apparatus as a replacement for the washing heard currently used thereon. To this end, the brush head 10 is attached to the actuator of the AVC-100 apparatus so that the connection portion 22 of the shaft 12 is connected to a rotating member in the actuator, a cover of the actuator engages with the annular groove 48 and covers the cavity 46, a suction conduit from a suction source and leading to a waste container is connected to the axial passage 30, and an inflow conduit leads to the cavity from a high-power pump in the AVC-100 apparatus.

The AVC-100 apparatus is wheeled to the location of the dissolution tester and the brush head 10 is inserted into one of the dissolution vessels 54 therein (to the position shown in FIG. 4). The sealing cover 16 is thus brought into contact with the upper edge of the dissolution vessel 54. The inflow housing 14 is urged against the sealing cover 16 to prevent the cleaning fluid from escaping from between the inflow housing 14 and the sealing cover 16.

A switch on the actuator is pressed to begin the cleaning cycle (discussed below). The high-power pump in the apparatus directs a high-pressure flow of cleaning fluid, such as water which is preferably heated, through the actuator to the cavity 46 from which the cleaning fluid is forced through the channels 52 against the guide disc 18 and then around the entire inner periphery of the dissolution vessel 54 (arrows showing the flow of cleaning fluid are shown in FIG. 4). Since the truncated conical portion 58 of the guide disc 18 aligns with part of the channels 52, the cleaning fluid contacts this portion and is advantageously urged outward.

At the same time, the shaft 12 is rotated causing rotation of the brush assembly 20. The bristles 64 on spiral brush 62 and the bristles 70 on brush members 66 brush against the inner wall of the dissolution vessel 54 to dislodge particle thereon. The combined flow of cleaning fluid along the inner wall of the dissolution vessel 54 and brushing action of the bristles 64,70 against the inner wall, ensures a thorough cleaning of the vessel 54.

Also at the same time, the vacuum tip 34 contacts the fluid at the bottom of the dissolution vessel 54 and the suction force being applied through the axial passage 30 draws this fluid upward through the axial passage 30. Continued suction force for the duration of the cleaning cycle also draws the cleaning fluid into the axial passage 30, which cleaning fluid carries particles dislodged from the inner wall of the dissolution vessel 54 by the brushes 64, 70.

In sum, during the cleaning cycle, cleaning fluid flows from the cavity 46 through the channels 52 and impacts the guide disc 18 to be re-directed thereby outward, i.e., against the inner wall of the dissolution vessel 54. In the illustrated embodiment, there are for channels in the base of the inflow housing; however, any number of channels can be provided.

Figure 5:
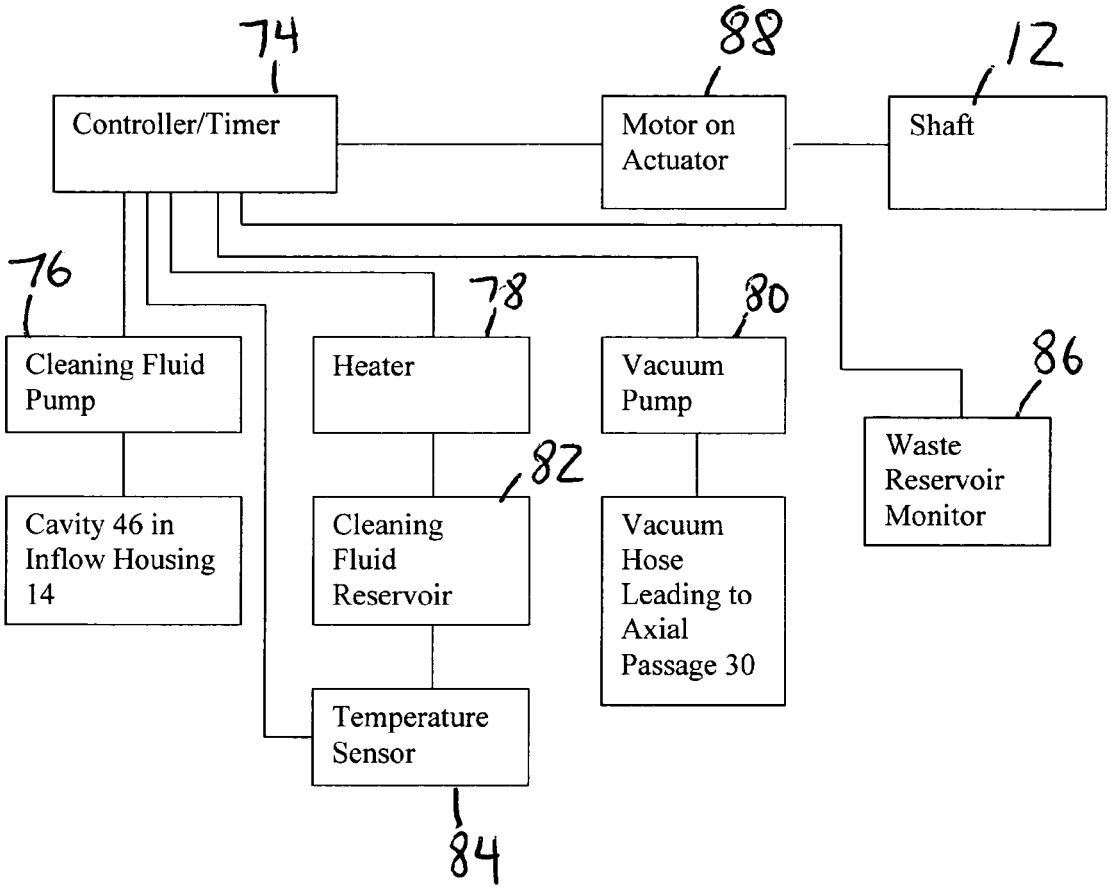
FIG. 5 is a schematic of major components of the apparatus in accordance with the invention.

Referring now to FIG. 5, components of an automatic apparatus for cleaning dissolution vessels after dissolution testing including elements of the AVC-100 described above and the brush head 10 in accordance with the invention are schematically illustrated. The apparatus includes a controller/timer 74 which controls the various components, namely, a cleaning fluid pump 76, a heater 78, and a vacuum pump 80. Cleaning fluid pump 76 is connected to the cleaning fluid reservoir 82 and when actuated by the controller 74, pumps cleaning fluid from the cleaning fluid reservoir 82 to the cavity 46 in flow housing 14. Heater 78 heats the cleaning fluid in the cleaning fluid reservoir 82 to a preset temperature, which can be determined by the user via a user interface connected to the controller 74. Controller 74 regulates the heater 78 based on the temperature readings provided by a temperature sensor 84 which measures the temperature of the cleaning fluid in the cleaning fluid reservoir 82.

Vacuum pump 80 creates a suction or vacuum force in the vacuum hose which draws fluid out of the vessel via the axial passage 30 when the brush head 10 is present in the dissolution vessel 54. The duration of operation of vacuum pump 80 during a cleaning cycle of a dissolution vessel 54 is controlled by controller 74.

Controller 74 is also connected to a waste reservoir monitor 86 to monitor the quantity of waste in the waste reservoir, for example, to prevent it from overflowing. Controller 74 is also connected to and controls a motor 88 which provides rotational force to the shaft 12 on which the brush assembly 20 is arranged.

The above described components, a side from the brush assembly 20, can be similar to or the same as those in the current assignee's automatic cleaning apparatus designated Model AVC-100, and their operation can also be the same. In other words, the brush head can be used as a replacement or substitute for the brush head in the AVC-100 apparatus.

Figure 6:
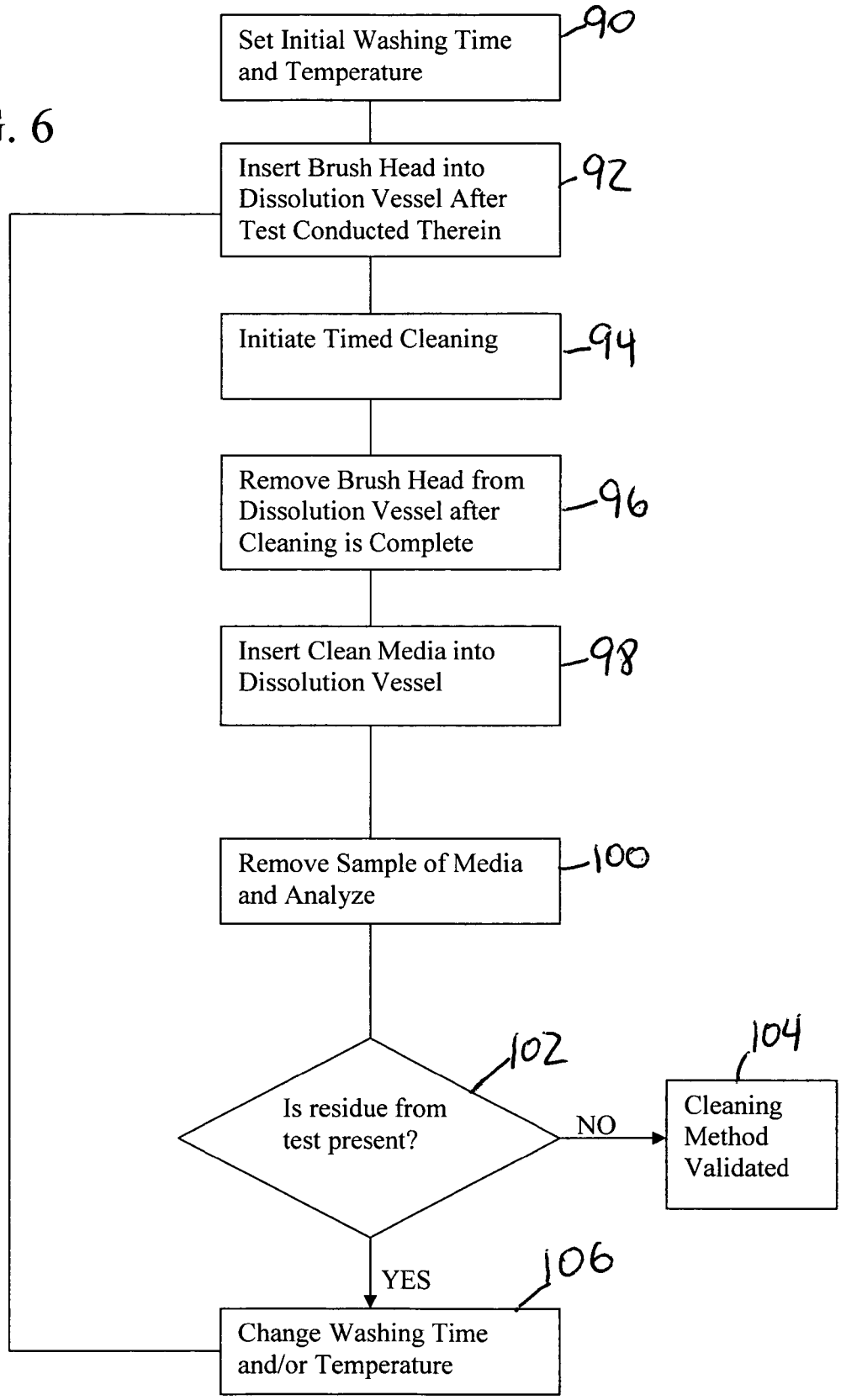
FIG. 6 is a flow chart showing the manner in which a cleaning validation method for an apparatus using the brush head in accordance with the invention is developed.

Referring now to FIG. 6, optimal use of the brush head 10 in a dissolution vessel cleaning apparatus entails developing a validation method which, when implemented, ensures that dissolution vessels cleaned by the brush head 10 are thoroughly cleaned and residue from drugs tested using the dissolution vessels has not remained adhered to the vessel walls. To this end, an automatic dissolution vessel cleaning apparatus using brush head 10 in accordance with the invention includes a built-in timer and a heater for heating cleaning fluid in a reservoir. The timer controls the duration that cleaning fluid is pumped into the cavity 46 and the duration that a suction force is applied through axial passage 30 whereas the heater is controlled by a temperature control device, such as a thermostat, to maintain it at a set temperature.

The initial step 90 in developing the validation method is to set the timer to provide for an initial washing time and the temperature control device to heat the cleaning fluid to an initial temperature. Brush head 10 is then inserted into one dissolution vessel after that dissolution vessel has been used in a test 92. Timed cleaning of the dissolution vessel is performed 94. The brush head 10 is then removed from the dissolution vessel 96 and clean media is inserted into the dissolution vessel 98. A sample of the media is then removed from the dissolution vessel for analysis 100, possibly after the media is stirred. This analysis can involve any conventional analytical method for detecting pharmaceutical agents known to those of ordinary skill in the art, for example, high performance liquid chromatography (HPLC). If the analysis 102 reveals that residue from the test is not present, the cleaning method has been validated 104. On the other hand, if the analysis reveals that residue is present, the cleaning method is not validated and the washing time and/or washing temperature must be changed 106. The brush head 10 is then inserted into another dissolution vessel, post-test, and the timed cleaning initiated. This process continues until a cleaning method for the dissolution vessels after a specific test has been validated.

It is possible that the initial temperature may be higher than needed for a validated cleaning method and/or that the washing time may be longer than needed for a validated cleaning method. After obtaining a validated cleaning method, the user can nevertheless decide to conduct additional cleaning tests by adjusting the temperature and washing time, e.g., reduce one or both of time, in order to arrive at a shorter cleaning method and/or one which is performed at a lower temperature.

Each test using the dissolution vessels may require a different method for cleaning the dissolution vessels, and each cleaning method must be validated. Thus, different drugs and table samples will have different associated, validated cleaning methods for the dissolution vessels used to test those drugs and tablet samples.

An example of a validation method developed by the current assignee, Logan Instruments Corp., entails set the temperature of the cleaning fluid, in this case water, to 45° C., setting the wash time to twenty seconds using the built-in timer, washing the vessel using brush head 10 with the 45° C. for twenty seconds, then adding clean media into the vessel and stirring with a clean bar and then remove a sample (media) from the vessel and analyzing it by HPLC. If the HPLC analysis indicates there is no residue, this cleaning method is validated.

The brush head 10 in the embodiment illustrated in FIGS. 1-4 and described above includes a brush assembly 20 having a spiral brush 62. This is only one example of a type of brush which is capable of brushing against the inner surface of the cylindrical portion of the wall of the dissolution vessel 54 during a cleaning cycle. There are other types of brushes or brush assemblies which can also be used on the brush head 10 in accordance with the invention instead of the spiral brush 62 and/or the brush members 66.

Figure 7:
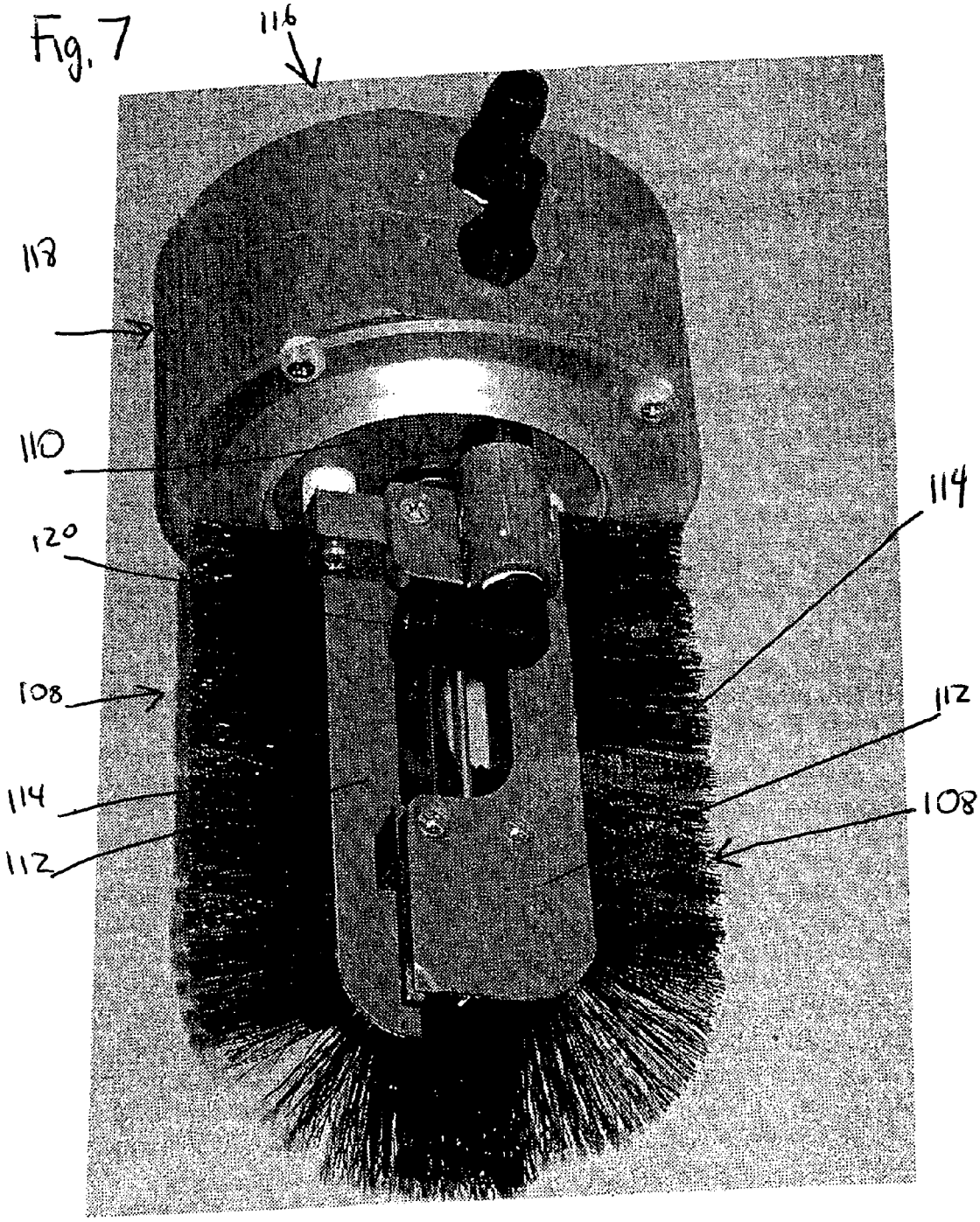
FIG. 7 is a view of another embodiment of a brush head in accordance with the invention.
Figure 1:
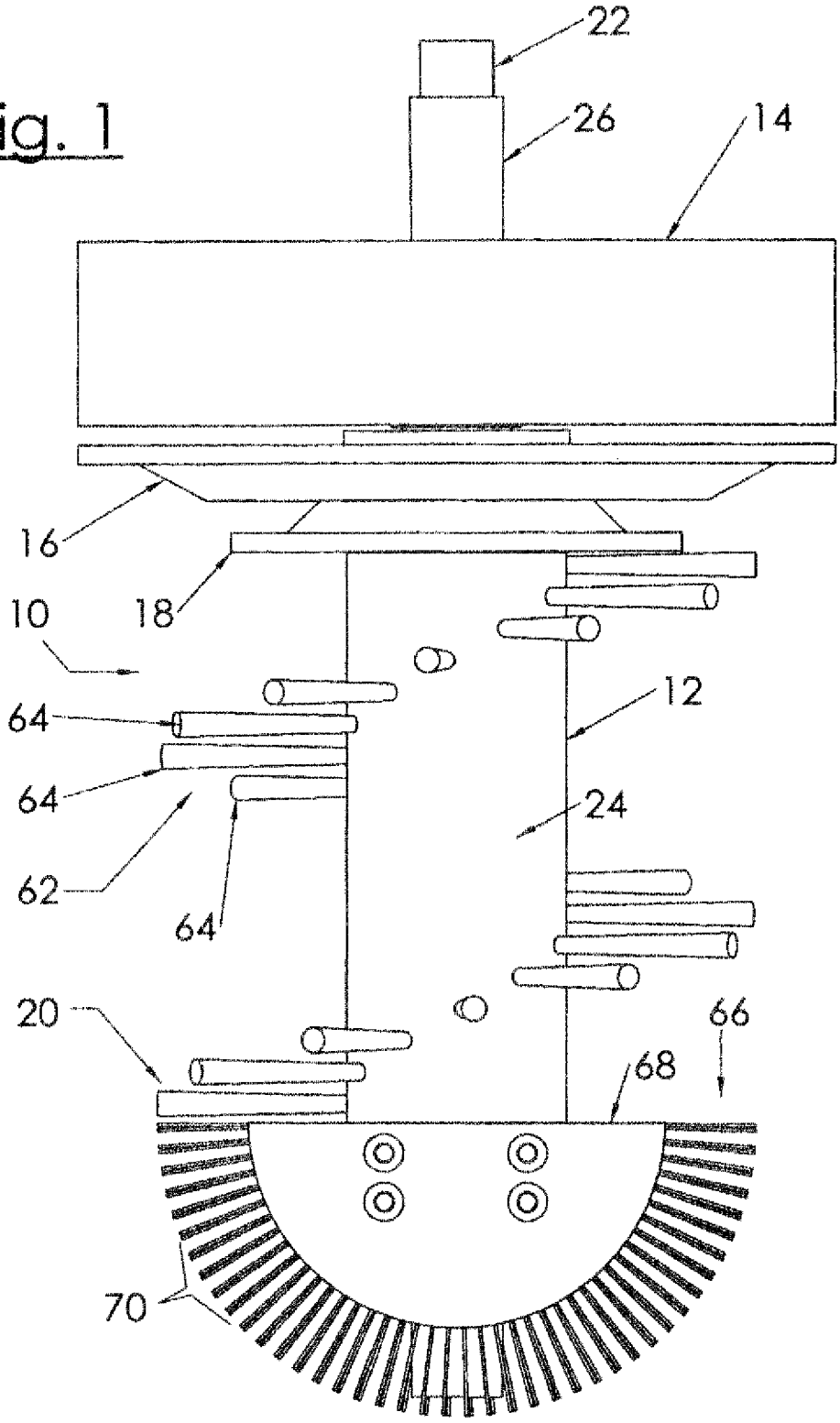
Figure 2:
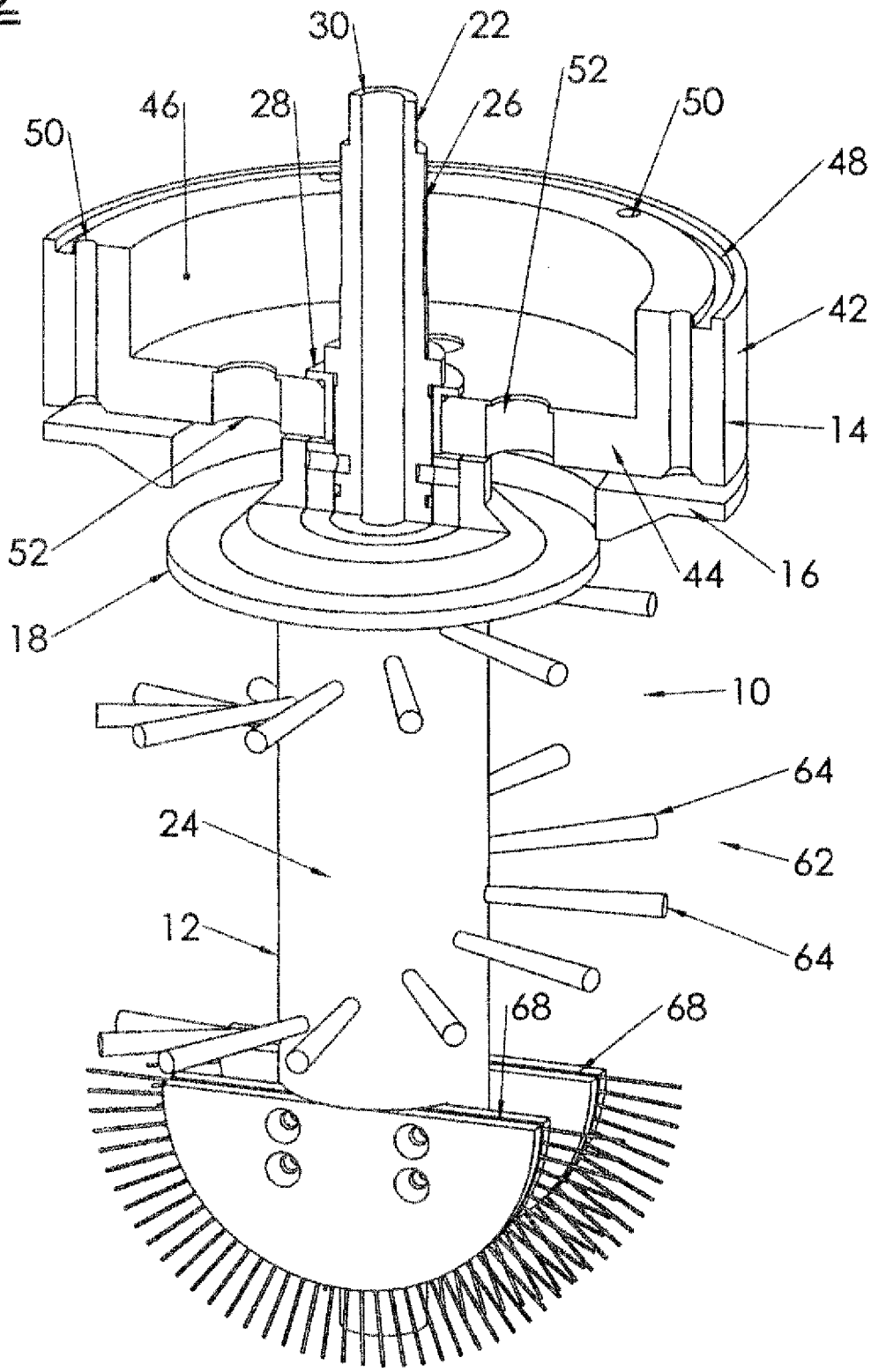
Figure 3:
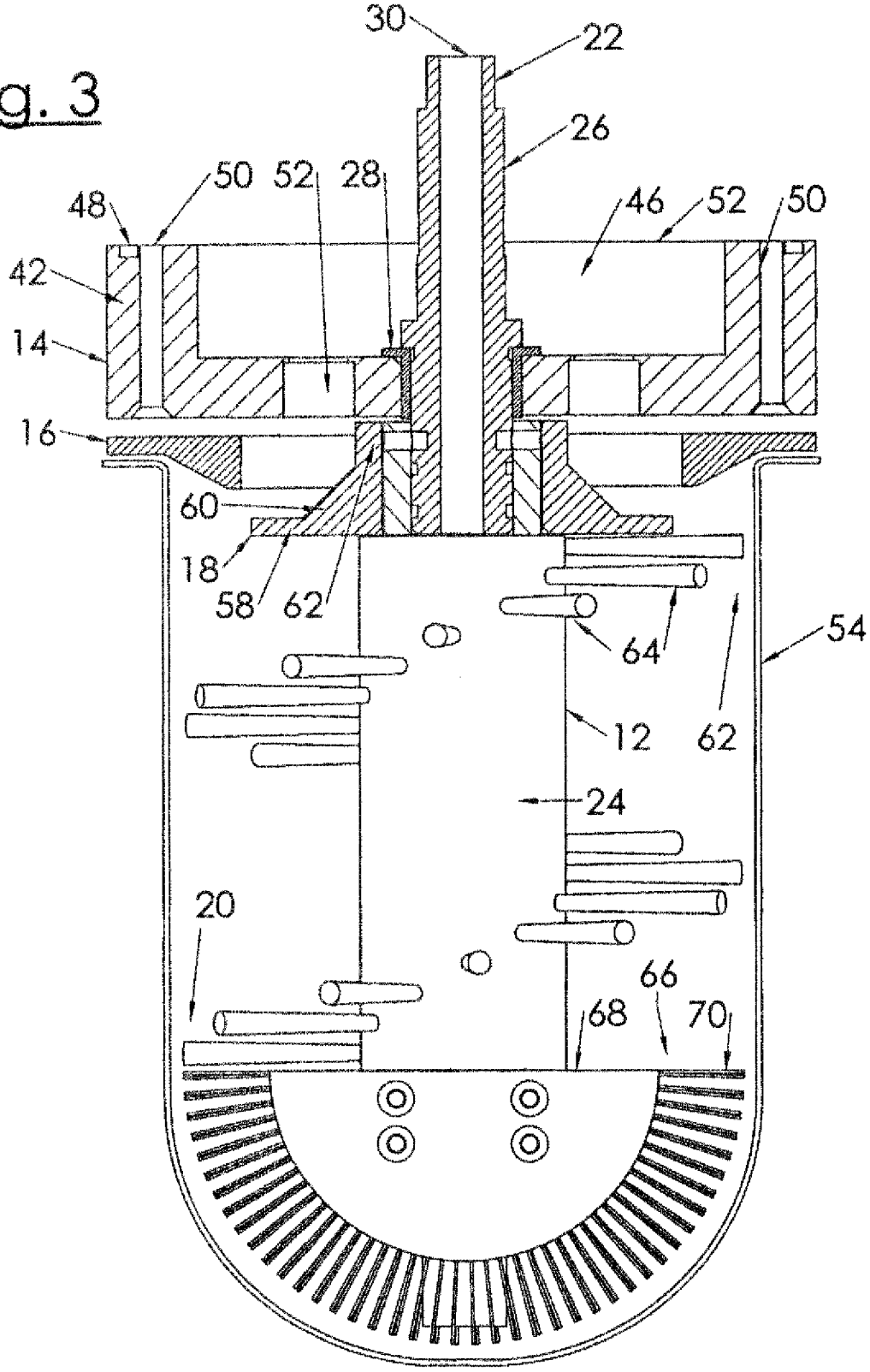
Figure 4:
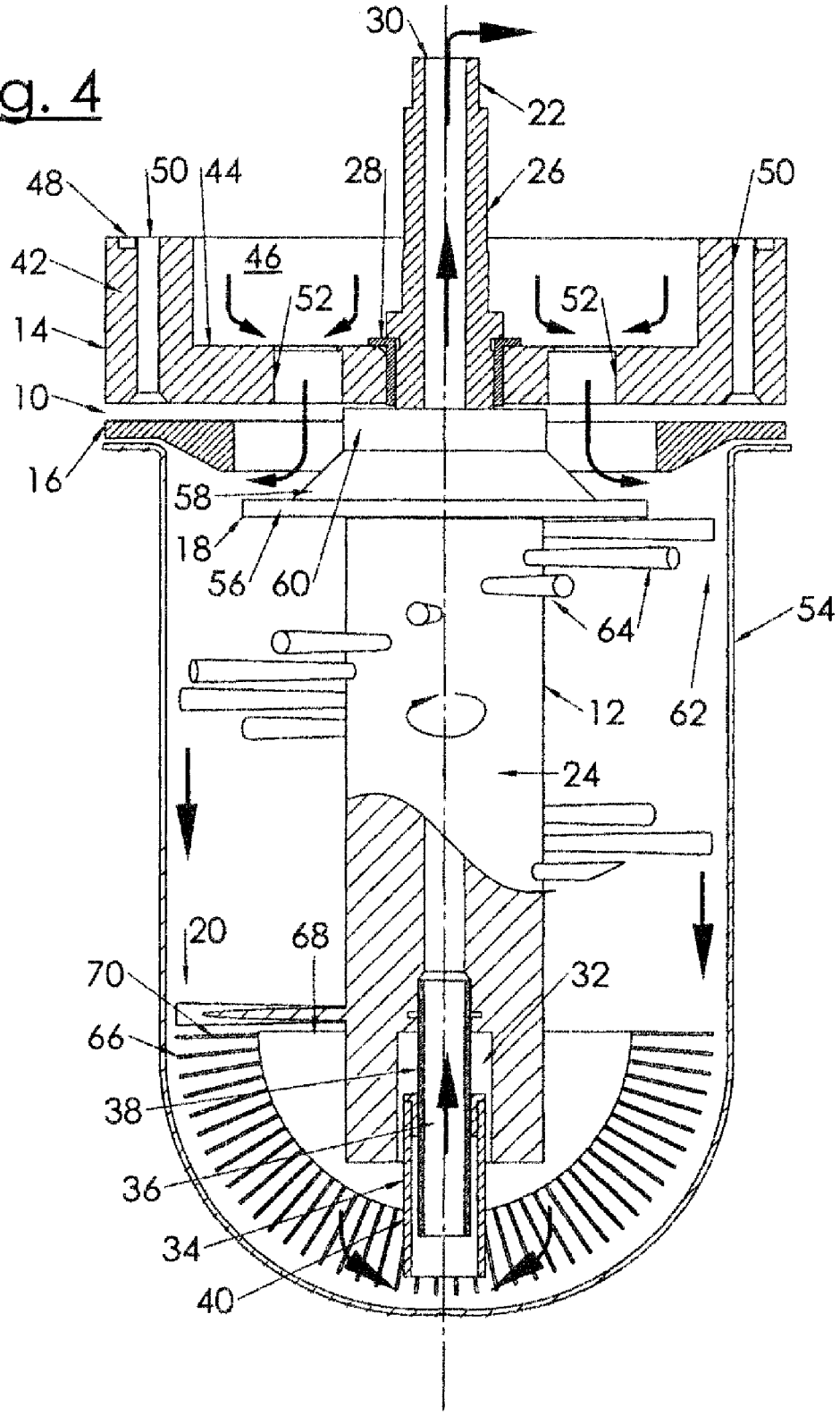
Figure 5:
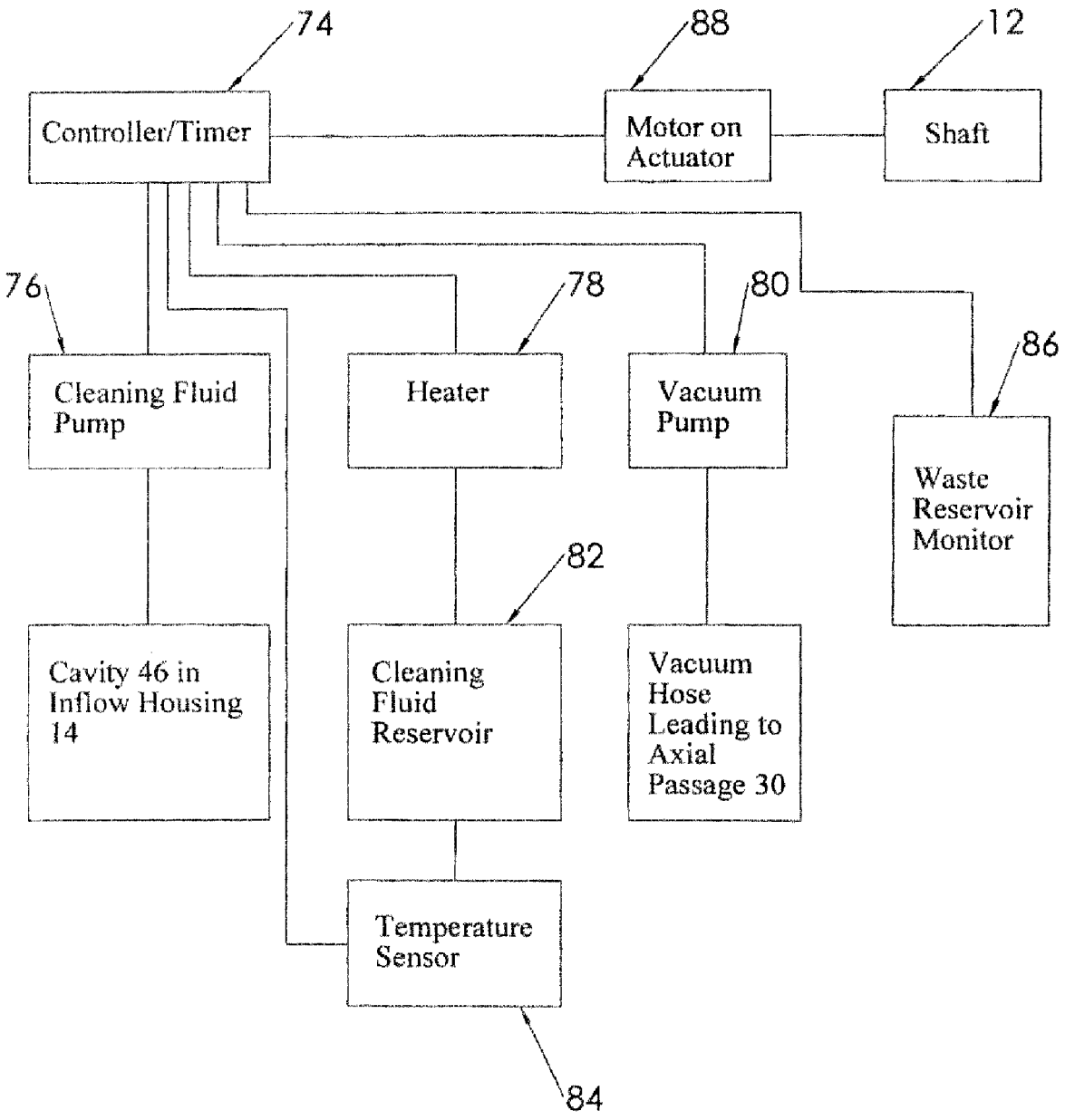
Figure 6:
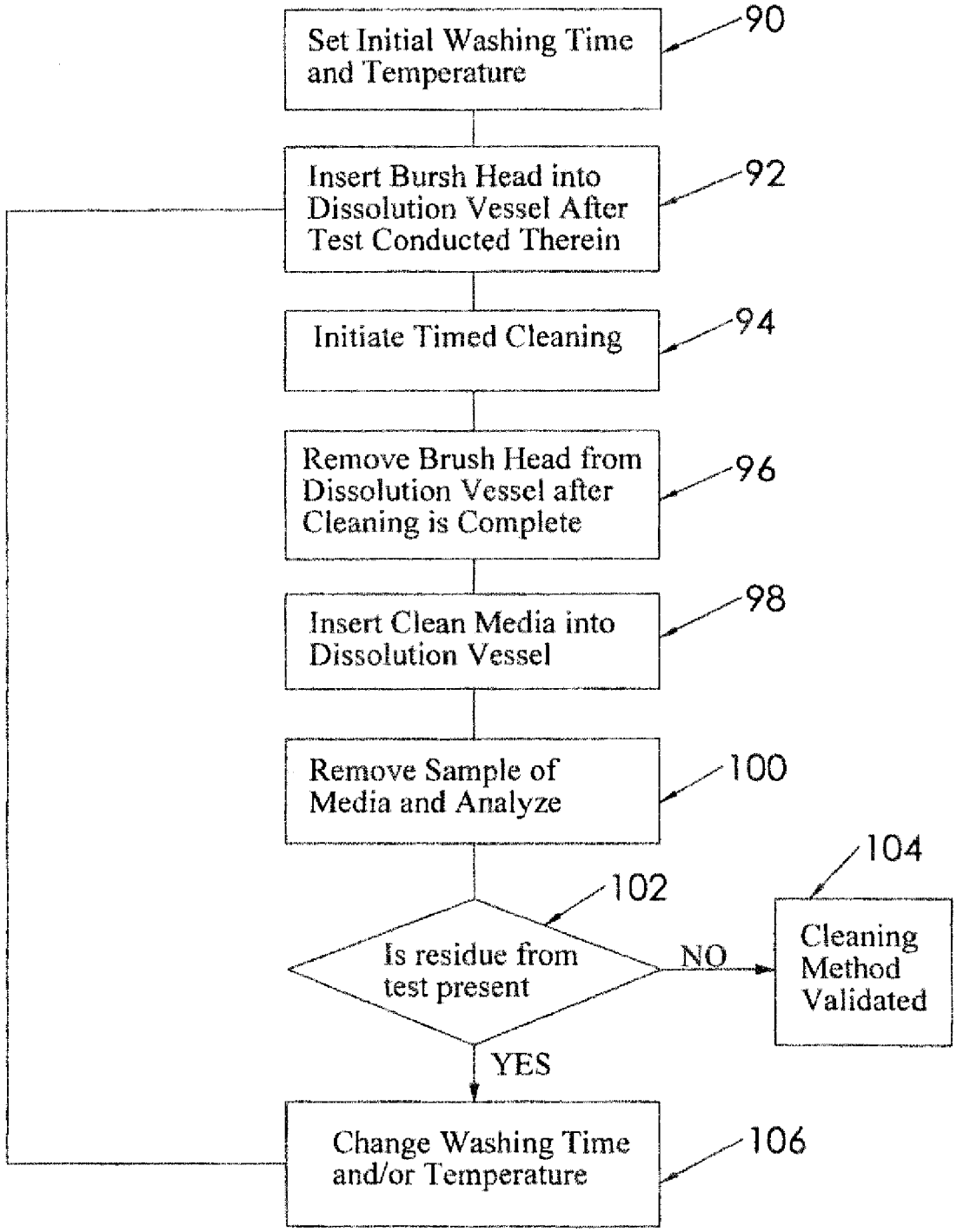
Figure 7:
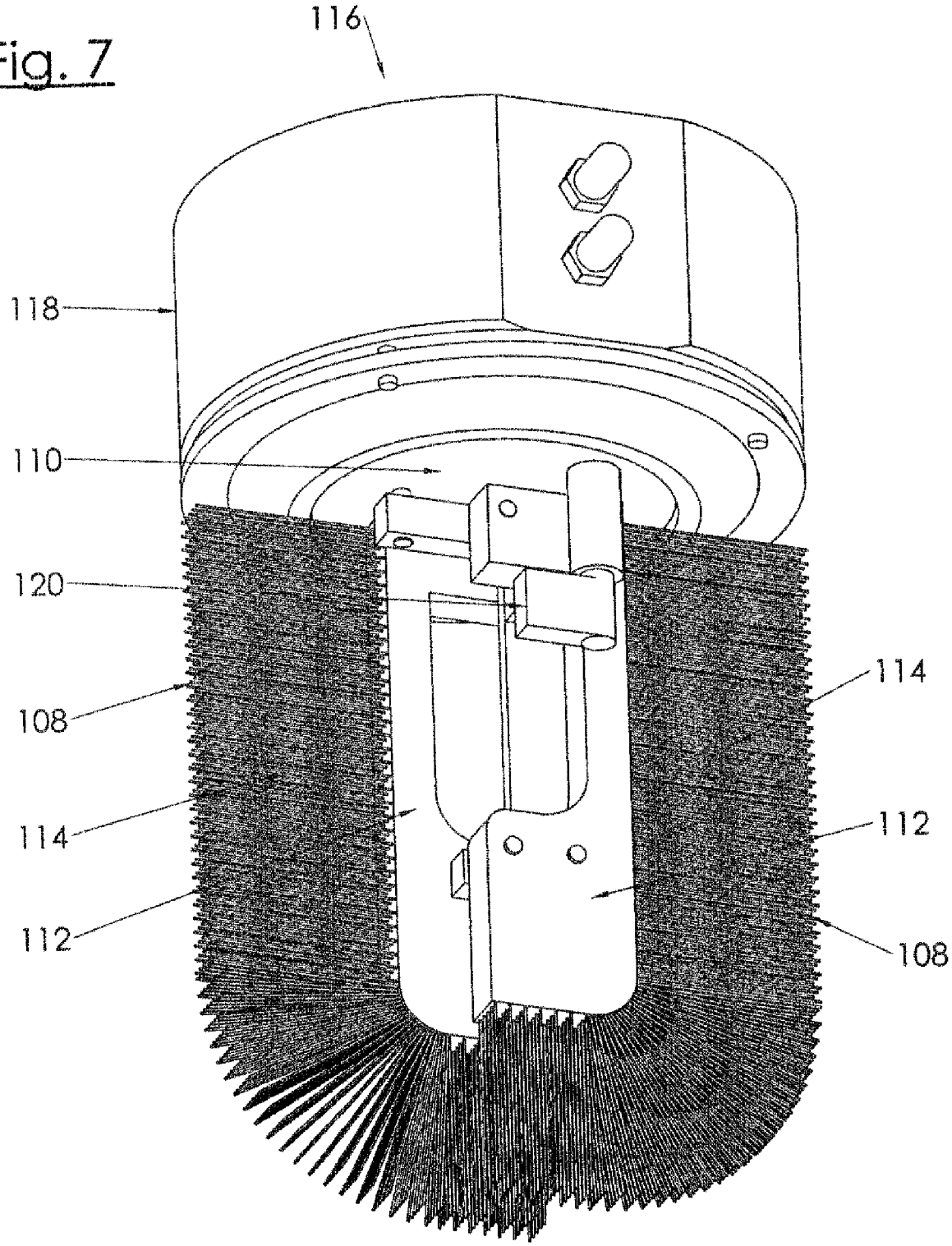

FIG. 7 shows one such brush assembly wherein a pair of brush members 108 project downward from a base 110, with each brush member 108 including a J-shaped frame 112 and bristles 114 arranged along substantially the entire outer circumferential surface of the frame 112. Bottom portions of the frames 112 overlap so that there is complete coverage of bristles 114 brushing against the inner surface of the wall of the dissolution vessel 54 when the brush head 116 including the brush members 108 is placed therein. Base 110 is rotatably mounted in the housing 118 and one or more nozzles 120 are mounted to the base 100 and communicate with a high-power pump (which may be part of the main unit of the AVC-100 apparatus as described above) for example, through flow conduits and connectors between the inlet of the nozzle (s) 120 and the pump. Rotation of the base 110 is provided, for example, by orienting the nozzle(s) 120 to provide a forced spray of cleaning fluid therethrough in a direction toward the wall of the dissolution vessel or by means of a motor which provides rotational force to the base 110. A vacuum tube extends through the base 110 to the bottom area of the brush members 108 (and is designed to be proximate the central region of the bottom of the dissolution vessel when the brush head 116 is placed therein) and leads to a suction source via conduits and connectors (in a similar manner as the axial passage 30 in the embodiment shown in FIGS. 1-4). In a modified embodiment, the brush members 108 can be mounted to the shaft 12 in the embodiment shown in FIGS. 1-4 instead of the spiral brush 62 and brush members 66. In this case, the inflow housing 14, sealing cover 16 and guide disc 18 could be used.

Another construction of the brush assembly 20 is as an O-type wherein groups of bristles are arranged in two circles and the circles are connected at one spot and then pull up an opposite side.

In view of the variations in the construction of the brush assembly such as those described above, the invention is not limited to any one particular construction and encompasses different brush assemblies which have bristles of sufficient number and relative arrangement to ensure that substantially the entire inner surface of the wall of a dissolution vessel is contacted by at least one bristle during rotation of the brush assembly.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

We claim:

1. A brush head for cleaning a vessel, comprising:

a rotatable shaft defining a through passage, an upper end of said passage being couplable to a vacuum source;

an inflow housing having at least one channel through which cleaning fluid is pumped, said shaft being rotatably mounted to said housing; and a brush assembly mounted on said shaft below said housing, a lower end of said passage being situated below said brush assembly, whereby when the brush head is inserted into the vessel, cleaning fluid is directed through said at least one channel into the vessel while said shaft rotates causing said brush assembly mounted thereon to rotate and clean an inner wall of the vessel with the fluid in the vessel being drawn into said passage via said lower end of said passage upon coupling of said upper end of said passage to the vacuum source.

2. The brush head of claim 1, wherein said brush assembly comprises a spiral brush attached to an outer surface of said shaft.

3. The brush head of claim 2, wherein said spiral brush comprises a series of discrete groups of bristles positioned to provide a downward spiral in a clockwise direction.

4. The brush head of claim 3, wherein said groups of bristles are arranged such that the distance between each group of bristles and said inflow housing increases in a direction toward a bottom of said shaft and each group of bristles is positioned behind the group of bristles immediately above in the clockwise direction.

5. The brush head of claim 2, wherein said brush assembly further includes a pair of semi-cylindrical brush members arranged at a bottom of said shaft on opposite sides thereof.

6. The brush head of claim 5, wherein each of said brush members comprises a semi-cylindrical plate attached to said shaft and bristles projecting outward from an outer circumferential, semi-cylindrical surface of said plate along the entire surface.

7. The brush head of claim 1, wherein said brush assembly includes a plurality of bristles arranged to ensure that substantially the entire inner surface of a wall of the vessel is contacted by at least one bristle during rotation of said brush assembly when the brush head is present in the vessel.

8. The brush head of claim 1, wherein said brush assembly includes a pair of brush members each including a J-shaped frame and bristles arranged along substantially the entire outer circumferential surface of said frame.

9. The brush head of claim 1, wherein said inflow housing has a bottom wall defining a cavity and includes said at least one channel which communicates with said cavity.

10. The brush head of claim 1, further comprising a vacuum tip arranged at a bottom of said shaft partially in said passage in said shaft, said vacuum tip having a movable part arranged to move relative to a level of liquid in the vessel and prevent flow of fluid from said passage into the vessel.

11. The brush head of claim 10, wherein said vacuum tip also includes a tubular member attached to said shaft, said movable part telescoping over said tubular member.

12. The brush head of claim 1, further comprising an annular sealing cover arranged around said shaft and below said inflow housing for engaging the vessel to prevent leakage of fluid from the vessel.

13. The brush head of claim 1, further comprising an annular guide disc arranged around said shaft in at least partial alignment with said at least one channel such that cleaning fluid passing through said at least one channel impacts said guide disc and is re-directed outward around the entire circumference of the brush head by said guide disc.

14. The brush head of claim 13, wherein said guide disc includes a truncated conical portion which changes the direction of flow of the cleaning fluid after passing through said at least one channel to radially outward directions.

15. In an automatic dissolution vessel cleaning apparatus including a hand-held actuator, means for pumping cleaning fluid to the actuator, means for drawing fluid from the actuator, and means for providing rotation to an element of the actuator, the improvement comprising:

a brush head comprising a rotatable shaft connected to the element of the actuator, said shaft defining a through passage, an upper end of said passage being couplable to the fluid drawing means;

an inflow housing having at least one channel through which cleaning fluid is pumped by the pumping means, said shaft being rotatably mounted to said housing; and a brush assembly mounted on said shaft below said housing, a lower end of said passage being situated below said brush assembly, whereby when the brush head is inserted into the vessel, cleaning fluid is directed by the pumping means through said at least one channel into the vessel while said shaft is rotated by the rotation providing means causing said brush assembly mounted thereon to rotate and clean an inner wall of the vessel with the fluid in the vessel being drawn into said passage via said lower end of said passage upon coupling of said upper end of said passage to the fluid drawing means.

16. The apparatus of claim 15, wherein said brush assembly comprises a spiral brush attached to an outer surface of said shaft, said spiral brush comprising a series of discrete groups of bristles positioned to provide a downward spiral in a clockwise direction.

17. The apparatus of claim 16, wherein said groups of bristles are arranged such that the distance between each group of bristles and said inflow housing increases in a direction toward a bottom of said shaft and each group of bristles is positioned behind the group of bristles immediately above in the clockwise direction.

18. The apparatus of claim 16, wherein said brush assembly further includes a pair of semi-cylindrical brush members arranged at a bottom of said shaft on opposite sides thereof, each of said brush members comprising a semi-cylindrical plate attached to said shaft and bristles projecting outward from an outer circumferential, semi-cylindrical surface of said plate along the entire surface.

19. The apparatus of claim 15, wherein said brush assembly includes a plurality of bristles arranged to ensure that substantially the entire inner surface of a wall of the vessel is contacted by at least one bristle during rotation of said brush assembly when the brush head is present in the vessel.

20. The apparatus of claim 15, wherein said brush assembly includes a pair of brush members each including a J-shaped frame and bristles arranged along substantially the entire outer circumferential surface of said frame.

* * * * *

UNITED STATES PATENT AND TRADEMARK OFFICE

CERTIFICATE OF CORRECTION

PATENT NO. : 7,543,354 B2
APPLICATION NO. : 11/267687
DATED : June 9, 2009
INVENTOR(S) : Luke Lee et al.

It is certified that error appears in the above-identified patent and that said Letters Patent is hereby corrected as shown below:

Title page should be deleted and substitute therefor the attached title page shown on the attached page.

The sheets of drawings consisting of Figures 1-7 should be deleted to appear as per attached Figures 1-7.

Signed and Sealed this

Thirteenth Day of October, 2009

David J. Kappos

David J. Kappos
*Director of the United States Patent and Trademark Office*

(12) United States Patent
Lee et al.

(10) Patent No.: US 7,543,354 B2
(45) Date of Patent: Jun. 9, 2009

(54) BRUSH HEAD FOR AUTOMATIC DISSOLUTION VESSEL CLEANER

(75) Inventors: Luke Lee, Belle Mead, NJ (US); Yu Sheng Zhang, Stewartsville, NJ (US)

(73) Assignee: Logan Instruments Corporation, Somerset, NJ (US)

( * ) Notice: Subject to any disclaimer, the term of this patent is extended or adjusted under 35 U.S.C. 154(b) by 641 days.

(21) Appl. No.: 11/267,687

(22) Filed: Nov. 4, 2005

(65) Prior Publication Data

US 2007/0101533 A1 May 10, 2007

(51) Int. Cl.
*A46B 13/04* (2006.01)
*B08B 9/087* (2006.01)

(52) U.S. Cl. ..... 15/302; 15/304; 15/56

(58) Field of Classification Search ..... 15/56--59, 15/65, 69-71, 104.9, 164, 246.5, 302, 304, 15/320, 322, 385

See application file for complete search history.

(56) References Cited

U.S. PATENT DOCUMENTS 2,726,415 A * 12/1955 Volckening ..... 15/104.9
5,109,562 A * 5/1992 Albrecht ..... 15/56

* cited by examiner

*Primary Examiner*--Mark Spisich
(74) *Attorney, Agent, or Firm*--Brian Roffe

(57) ABSTRACT

Brush head for cleaning a vessel and use in an automatic dissolution vessel cleaning apparatus which includes a rotatable shaft defining a through passage, an upper end of which is operatively connected to a vacuum source, an inflow housing having at least one channel through which cleaning fluid is pumped and to which the shaft is rotatably mounted, and a brush assembly mounted on the shaft below the housing such that a lower end of the passage is situated below the brush assembly. In use, when the brush head is inserted into the vessel, cleaning fluid is directed through the channel(s) into the vessel while the shaft rotates causing the brush assembly to rotate and clean an inner wall of the vessel with fluid in the vessel being drawn into the passage via its lower end upon coupling of its upper end to the vacuum source.

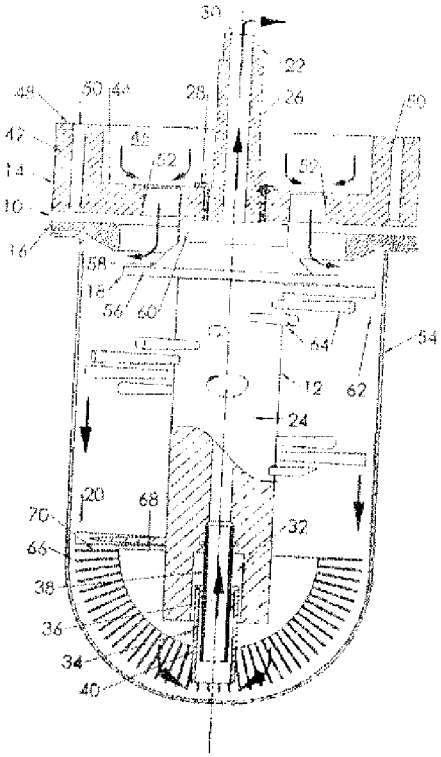

20 Claims, 7 Drawing Sheets